US006741718B1

(12) United States Patent
Brumitt et al.

(10) Patent No.: US 6,741,718 B1
(45) Date of Patent: May 25, 2004

(54) NEAR-FIELD SPEAKER/MICROPHONE ACOUSTIC/SEISMIC DAMPENING COMMUNICATION DEVICE

(75) Inventors: Marcia R. Brumitt, San Diego, CA (US); Medford A. Dyer, San Diego, CA (US); Edward D. Springer, Chula Vista, CA (US)

(73) Assignee: GN Jabra Corporation, San Diego, CA (US)

( * ) Notice: Subject to any disclaimer, the term of this patent is extended or adjusted under 35 U.S.C. 154(b) by 0 days.

(21) Appl. No.: 09/649,548

(22) Filed: Aug. 28, 2000

(51) Int. Cl.[7] ..... H04R 25/00

(52) U.S. Cl. ..... 381/370; 381/375; 381/380; 379/430

(58) Field of Search ..... 381/322, 324, 381/328, 355, 357, 358, 360, 361, 362, 380, 370, 371, 375, 379, 182; 181/129, 130, 135; 379/430

(56) References Cited

U.S. PATENT DOCUMENTS

| | | | | | |
|---|---|---|---|---|---|
| 4,334,315 | A | | 6/1982 | Ono et al. | 455/11.1 |
| 4,546,267 | A | | 10/1985 | Urfirer | 307/116 |
| 4,588,867 | A | | 5/1986 | Konomi | 379/430 |
| 4,696,045 | A | | 9/1987 | Rosenthal | 381/114 |
| 4,975,967 | A | * | 12/1990 | Rasmussen | 381/328 |
| 5,164,984 | A | | 11/1992 | Suhami et al. | 379/444 |
| 5,210,792 | A | | 5/1993 | Kajihara | 379/430 |
| 5,222,151 | A | | 6/1993 | Nagayoshi et al. | 381/380 |
| 5,228,092 | A | | 7/1993 | Nakamura et al. | 381/151 |
| 5,298,692 | A | * | 3/1994 | Ikeda et al. | 381/380 |
| 5,345,509 | A | | 9/1994 | Hofer et al. | 381/68.6 |
| 5,448,637 | A | | 9/1995 | Yamaguchi et al. | 379/430 |
| 5,497,182 | A | | 3/1996 | Park | 347/197 |
| 5,504,812 | A | | 4/1996 | Vangarde | 379/430 |
| 5,511,132 | A | | 4/1996 | Yoshimi | 381/386 |
| 5,521,982 | A | | 5/1996 | Schiftan | 381/25 |
| 5,544,253 | A | | 8/1996 | Nagayoshi et al. | 381/187 |
| 5,586,195 | A | | 12/1996 | Ishigaki et al. | 381/386 |
| 5,606,607 | A | | 2/1997 | Yamaguchi et al. | 379/430 |
| 5,613,222 | A | | 3/1997 | Guenther | 455/568 |
| 5,659,620 | A | | 8/1997 | Kuhlman | 381/312 |
| 5,664,014 | A | | 9/1997 | Yamaguchi et al. | 379/430 |
| 5,687,230 | A | | 11/1997 | Olaussen et al. | 379/428 |
| 5,692,059 | A | | 11/1997 | Kruger | 381/151 |
| 5,706,359 | A | * | 1/1998 | Chang | 381/355 |
| 5,729,615 | A | | 3/1998 | Yang | 381/370 |
| 5,745,579 | A | | 4/1998 | Newman | 380/52 |
| 5,757,934 | A | | 5/1998 | Yokoi | 381/68.3 |
| 5,761,298 | A | | 6/1998 | Davis et al. | 379/430 |
| 5,787,166 | A | | 7/1998 | Ullman | 379/430 |
| 5,790,684 | A | | 8/1998 | Niino et al. | 381/68.3 |
| 5,793,865 | A | | 8/1998 | Leifer | 379/430 |
| 5,844,984 | A | | 12/1998 | Yamaguchi et al. | 379/430 |
| 5,845,197 | A | | 12/1998 | Hada et al. | 455/90 |
| 5,875,251 | A | | 2/1999 | Sun | 381/151 |
| 5,909,490 | A | | 6/1999 | Sokolich et al. | 379/433 |
| 5,909,498 | A | * | 6/1999 | Smith | 381/380 |
| 5,933,506 | A | | 8/1999 | Aoki et al. | 381/151 |
| 5,999,822 | A | | 12/1999 | Wicks et al. | 455/550 |

(List continued on next page.)

*Primary Examiner*—Suhan Ni
(74) *Attorney, Agent, or Firm*—Lloyd W. Sadler

(57) ABSTRACT

A communication device and overmold adapted to minimize the feedback, acoustic coupling, and seismic vibration between a speaker and microphone in close proximity, as is typically found in hands-free headsets, is provided. This invention, through the use of specific structures absorbs unwanted noise and sound waves thereby improving the performance of the communication system as a whole. The complete system of this invention is provided in several embodiments, including an embodiment where the microphone is inserted within the overmold structure, an embodiment where the microphone is a boom microphone and an embodiment where the microphone is somewhat remote (a few inches) down from a miniaturized overmold and is provided with an ON/OFF switch.

7 Claims, 7 Drawing Sheets

U.S. PATENT DOCUMENTS 6,064,894 A 5/2000 Zurek et al. ..... 455/569
6,069,964 A 5/2000 Yang ..... 381/374
6,084,976 A * 7/2000 Lin ..... 381/380
6,085,113 A 7/2000 Fan ..... 455/569
6,097,809 A 8/2000 Lucey et al. ..... 379/430
6,097,826 A * 8/2000 Clavadetscher et al. .... 381/322
6,374,126 B1 * 4/2002 MacDonald, Jr. et al. .. 381/375

* cited by examiner

NEAR-FIELD SPEAKER/MICROPHONE ACOUSTIC/SEISMIC DAMPENING COMMUNICATION DEVICE

BACKGROUND OF THE INVENTION

1. Field of the Invention

This invention relates to devices and methods for decoupling microphones and speakers that are in close proximity to each other. More specifically, this invention relates to devices and methods, which provide microphone-speaker decoupling through the use of an acoustic molded device.

2. Description of Related Art

A variety of different methods and devices have been proposed for controlling the interference between a speaker—microphone pair in a communications system. Generally however, these devices and methods are ineffective with speakers and microphones in close proximity, while other devices require the use of a material or materials, which are difficult and expensive to manufacture effectively.

The reader is referred to the following U.S. patent documents for general background material: U.S. Pat. Nos. 4,334,315, 4,546,267, 4,588,867, 4,696,045, 5,164,984, 5,210,792, 5,222,151, 5,228,092, 5,345,509, 5,448,637, 5,497,182, 5,504,812, 5,511,132, 5,521,982, 5,544,253, 5,586,195, 5,606,607, 5,613,222, 5,659,620, 5,664,014, 5,687,230, 5,692,059, 5,729,615, 5,745,579, 5,757,934, 5,761,298, 5,787,166, 5,790,684, 5,793,865, 5,844,984, 5,845,197, 5,875,251, 5,909,490, 5,933,506, 5,999,822, 6,064,894, 6,069,964, 6,085,113, 6,097,809. Each of these patent documents is hereby incorporated by reference in its entirety for the material contained therein.

SUMMARY OF THE INVENTION

It is desirable to provide an acoustic decoupling device, that minimizes microphone-speaker interference in a communication device having the microphone in close proximity to the speaker, which has a channel for routing wiring, provides a strain relief and which is composed of materials that are insensitive to both seismic and acoustic vibrations.

Therefore, it is an object of this invention to provide a decoupling damping device for use in a communication system that has the microphone and speaker in close proximity, as described and recited in the claims.

This and other objects of this invention are achieved by the apparatus herein described and are readily apparent to those of ordinary skill in the art upon review of the following drawings, detailed description and claims.

BRIEF DESCRIPTION OF THE DRAWINGS

In order to show the manner that the above recited and other advantages and objects of the invention are obtained, a more particular description of the preferred embodiments of this invention, which is illustrated in the appended drawings, is described as follows. The reader should understand that the drawings depict only present preferred and best mode embodiment of the invention, and are not to be considered as limiting in scope. A brief description of the drawings is as follows.

Reference will now be made in detail to the present preferred embodiment of the invention, examples of which are illustrated in the accompanying drawings.

DETAILED DESCRIPTION OF THE INVENTION

This invention is an apparatus to dampen interference and feedback from a speaker—microphone pair, which are in close proximity to each other. This invention also provides a routing channel for wiring in a wearable ear set, as well as strain relief. In its present mode, this invention accomplishes seismic vibration control by the careful choice of a semi-rigid (soft) PVC molded overmold part, which absorbs shock waves that tend to travel through the speaker/microphone housing. Also, the use of a semi-rigid, molded part to acoustically isolate the speaker and microphone from each other increases manufacturing yield by minimizing manufacturing variance, thereby increasing communication device quality while reducing manufacturing costs. For the purposes of this disclosure, the terms "cell phone" and "cellular telephone" is to be defined to include any mobile telephone, including but not limited to traditional cellular telephones, PCS telephones, satellite phones, radio phones and wired traditional telephones.

As the use of cellular telephones has increased in automobiles a corresponding increase in traffic accident rates has occurred resulting from automobile drivers being distracted from the road and/or traffic conditions by the use of their cell phones. Accordingly, the public and lawmakers are demanding either that hands-free headsets be provided or that cell phone use in vehicles be banned. Hands-free headsets are also increasing in use in the office and home environment. Both computer voice recognition and office productivity requirements are increasing the demand for hands-free telephone headsets. Hands-free headsets have often had certain technical problems, often including feedback and cross-talk between the speaker and the microphone due to the relative close proximity of the speaker to the microphone. Addressing the problem of feedback, crosstalk, vibration and the like has been a long-standing need and priority in the headset communication device industry. This invention addresses this problem by providing a near-field speaker/microphone acoustic and seismic vibration dampening device, thereby increasing the effectuality of hands-free headsets for use with both cellular telephones and standard telephone or computer equipment.

Figure 1A:
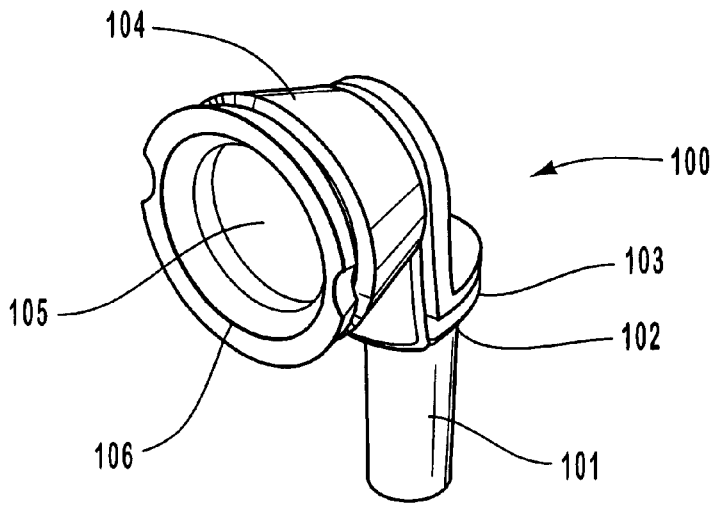
FIGS. 1*a* and 1*b* are perspective views of a first present preferred embodiment of this invention.

FIG. 1*a* shows a perspective view of the front of the first preferred device of this invention. Referred to herein as a first overmold 100, this device is preferably constructed as a single molded PVC part, although alternative materials, including but not limited to soft plastic, rubber, ceramic, high density foam, and the like may be substituted with reduced performance without departing from the concept of this invention. The construction of this present embodiment is as follows. A stem 101 is fixed to the bottom 102 of the mold 103 to provide cable strain relief. The mold 103 has a cavity portion 105 defined by a generally conically shaped wall 104. A snap ring attachment portion 106 is provided on the outer surface of the conically shaped wall 104.

Figure 1B:
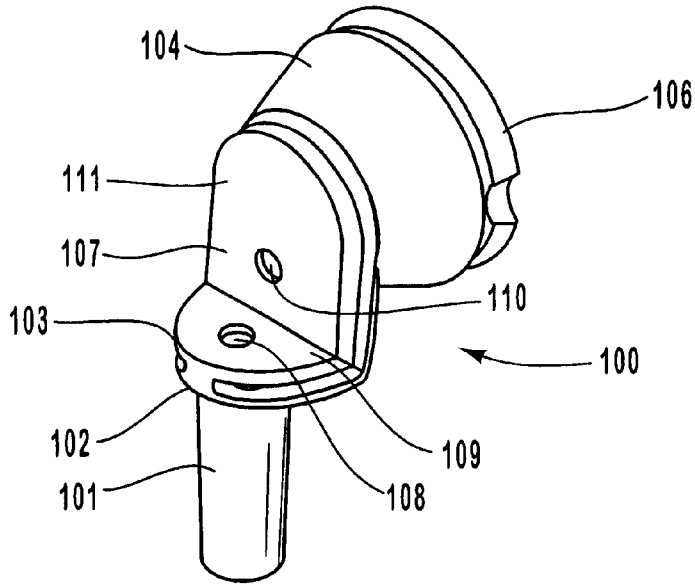

FIG. 1*b* shows a perspective view of the rear of the first preferred device of this invention. Besides showing the stem 101, the mold 103, the conically shaped wall 104 and the snap portion attachment 106, this view also shows the microphone recess 107. The microphone recess 107 is formed in the overmold 100 in order to support the desired microphone 202 (see FIGS. 2*a,* 2*b*). At the base 109 of the microphone recess 107 is provided a channel 108 for wiring connection between the microphone 202 and the phone connection wire 201 (see FIGS. 2*a,* 2*b*). A second wiring channel 110, in the rear 111 of the microphone recess 107, provides for the communication of wiring between the speaker 207 and the phone connection wire 201.

Figure 2A:
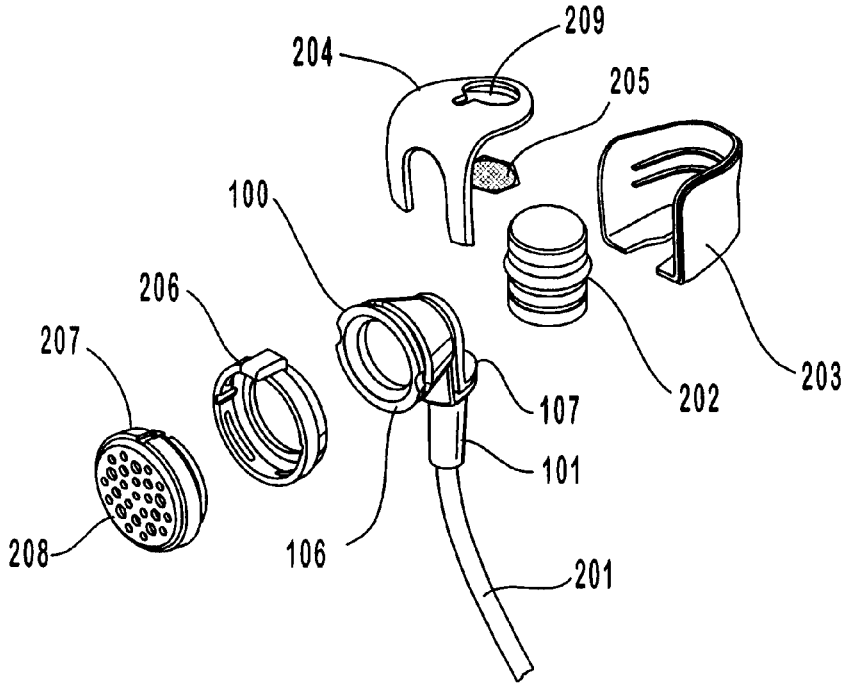
FIGS. 2*a* and 2*b* are perspective break-out drawings showing the first present preferred embodiment of this invention in association with a preferred communication system.

FIG. 2*a* shows a front perspective view of a break-out of the component parts of this first preferred device of this invention. The overmold 100 is shown with the stem 101 connected to the phone connection wire 201. The snap ring 206 is shown in relation to the snap portion attachment 106, to which it is attached in the complete assembly 300 (see FIG. 3). The speaker assembly 207, having a speaker grill 208 installed therein, is shown in relation to the snap ring 206, to which it is attached in the complete assembly 300. A top shell 204 is provided as a top cover for the microphone 202, which is also shown in proximity to the microphone recess 107, where it would be installed in the complete assembly 300. A microphone grill 205 is shown between a microphone opening 209 in the top shell 204 and the microphone 202, where the microphone grill 205 would be installed in the complete assembly 300. Behind, and in the complete assembly 300 forming the rear of the assembly, is shown the bottom shell 203. The bottom shell 203 is adapted to tightly fit to the overmold 100, as shown in further detail in FIG. 4, to enclose the microphone 202.

Figure 2B:
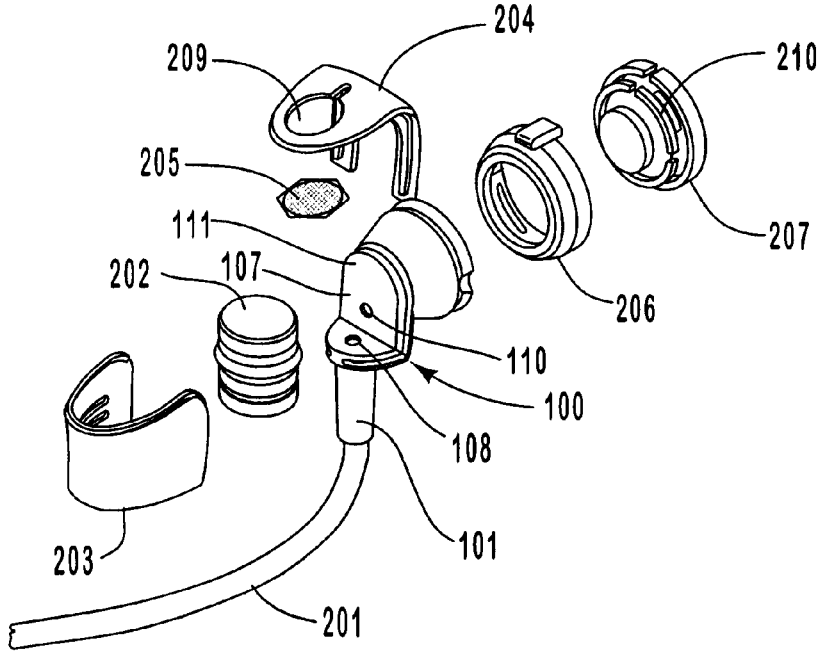

FIG. 2*b* shows a rear perspective view of a break-out of the component parts of this first preferred device of this invention. This view provides another perspective of the components of this invention. Specifically, this view gives additional detail on the preferred interface 210 between the speaker 207 and the snap ring 206, as well as the wiring channel openings 108, 110.

Figure 3:
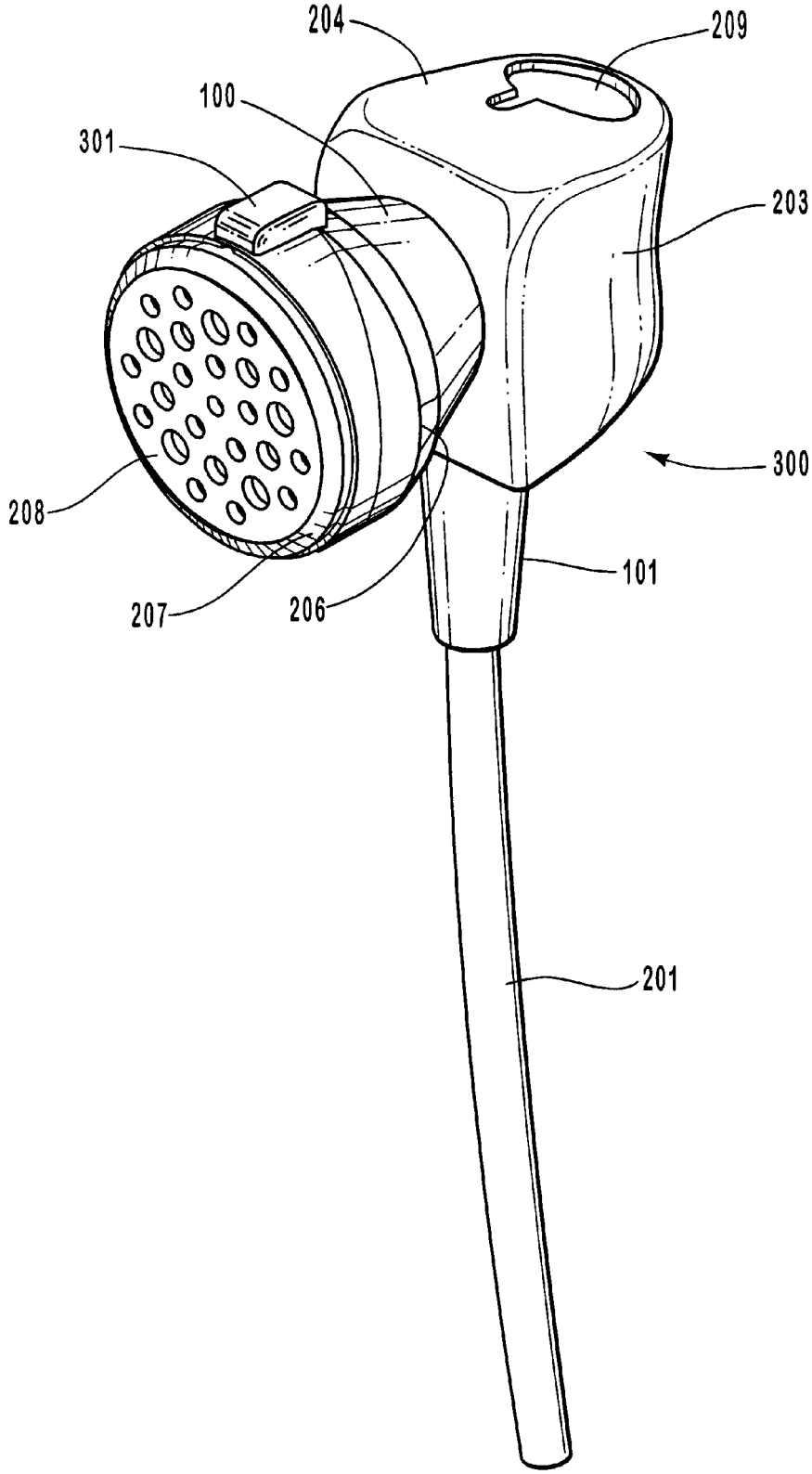
FIG. 3 is a perspective view of the assembled system of the first present preferred embodiment of this invention.

FIG. 3 shows a front perspective view of a fully assembled first embodiment 300 of this invention. The overmold 100 is shown with the snap ring 206 fitted thereto. Fixed to the snap ring 206 is the speaker 207, with the speaker grill 208 fitted therein. The speaker 207 is held in place to the snap ring 206 by a clip 301. The top shell 204 along with the bottom shell 203 are fitted to the overmold 100. The stem 101 is shown between the phone wire connection 201 and the overmold 100. In this present preferred embodiment of this invention 300 the components are fixed together by friction fit along with the clip 301. Envisioned alternative means of fixing the components together include, but are not limited to, adhesive, screws, bolt, pins, welds, pressure press and the like. The overmold 100 is typically made of a soft PVC plastic material and the shell components 203, 204 are presently made of ABS plastic, although alternative materials such as soft plastic, rubber, ceramic or metal can be substituted without departing from the concept of this invention. The microphone 202 is a standard commercial miniaturized microphone. The speaker 207, similarly is a standard commercial miniaturized speaker. The snap ring 206 is presently made of ABS plastic, although alternatively it could be made of other synthetic materials, rubber or metal.

Figure 4:
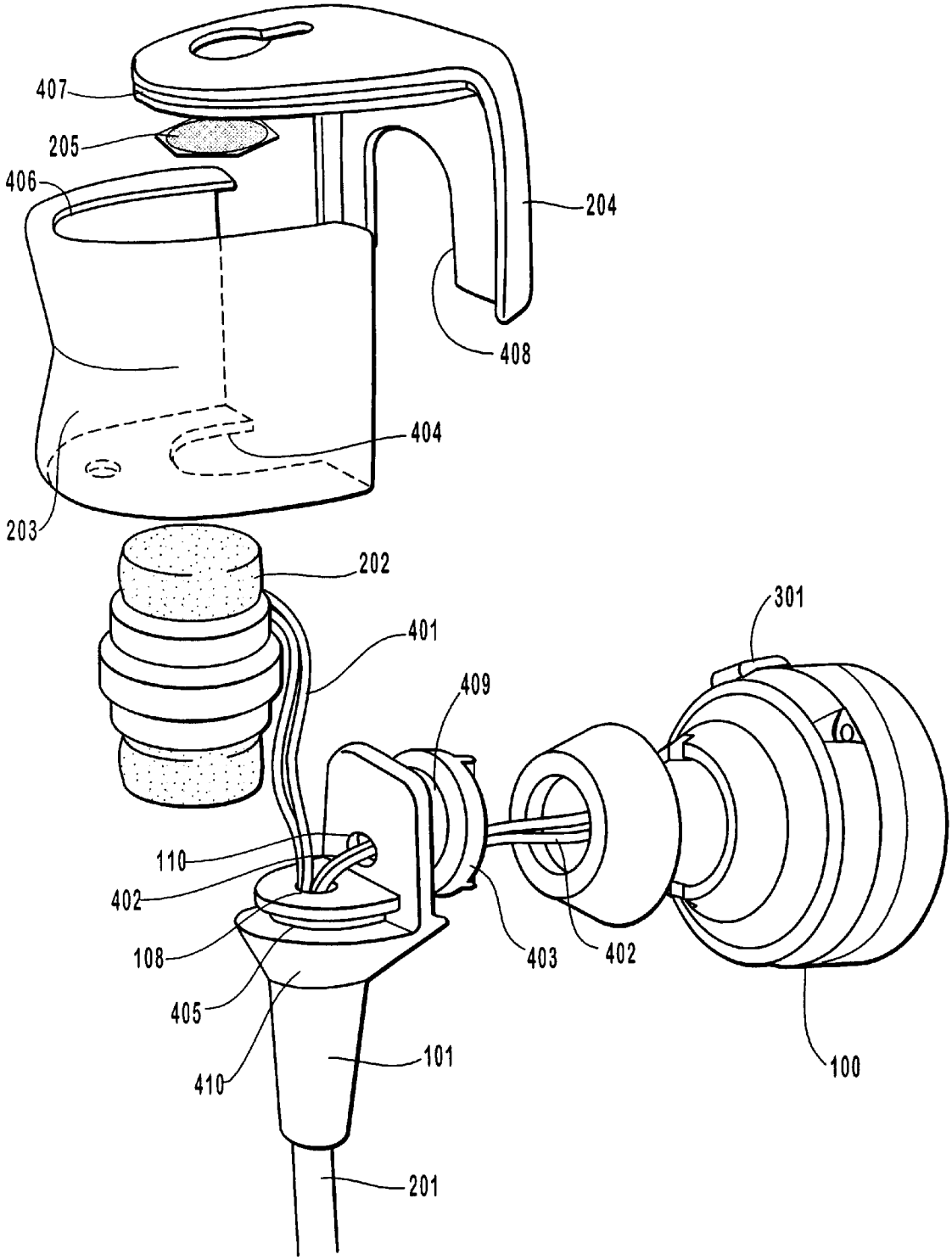
FIG. 4 is a perspective detail drawing of the first present preferred embodiment of this invention connected to a preferred microphone.

FIG. 4 shows a perspective detail drawing of the first present preferred embodiment of this invention connected to a preferred microphone. This view shows the routing of wiring 401, 402 within the provided channels 108, 110. Wiring 401 provides the electrical connection between the microphone 202 and the telephone connection wiring 201. The wiring 402 between the speaker 207 (see FIGS. 2*a,* 2*b* and 3) is shown extending through the opening 110 and into the overmold 100. The bottom shell 203 connects to rear portion 410 of the overmold 100 by fitting the bottom edge 404 into the first overmold slot 405. While the top shell 204 connects to the rear portion 410 of the overmold 100 by fitting the rear edge 408 into the second overmold slot 409, between the rear portion 401 of the overmold 100 and the interior fitting 403 of the overmold 100. The bottom shell 203 is fitted to the top shell 204 by inserting the top edge 406 into the top slot 407 of the top shell 204. While these fittings are typically held in place by a friction fit, adhesive, screws, pins, bolts and welds may be substituted or added without departing from the concept of this invention, and should be considered as within the means of fittings.

Figure 5:
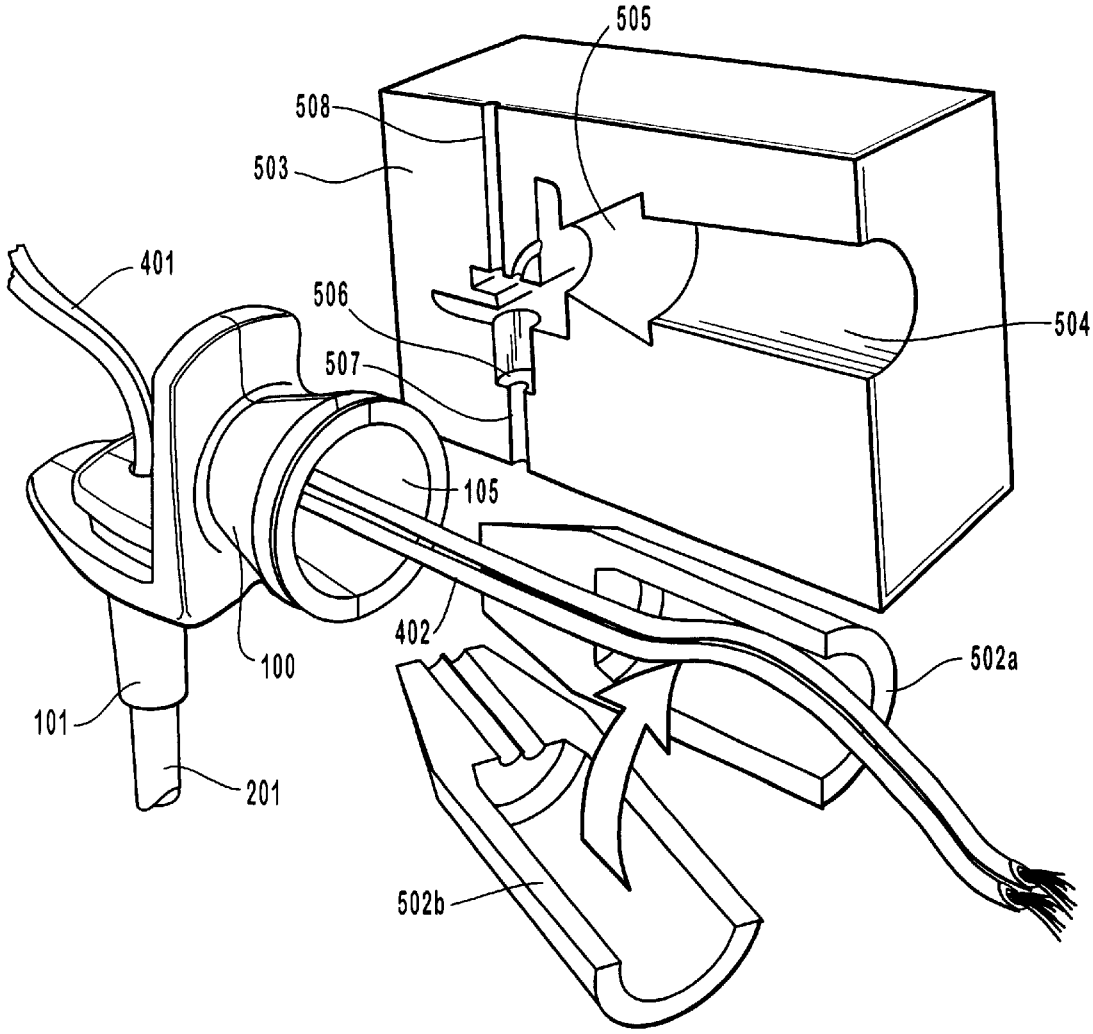
FIG. 5 is a perspective detail drawing of the first present preferred embodiment of this invention showing the cable channel and interface to the preferred speaker.

FIG. 5 shows a perspective detail drawing of the first present preferred embodiment of this invention showing the cable channel and interface to the preferred speaker. A mold cavity 503 is provided with a wiring recess 508, a post recess 507, a overmold rear portion recess 506, a overmold recess 505 and a split core pin recess 504. A split core pin, having a first side 502*a* and a second side 502*b* is provided to fit within the cavity 105 of the overmold 100 and is shown with the speaker wiring 402 carried within.

Figure 6:
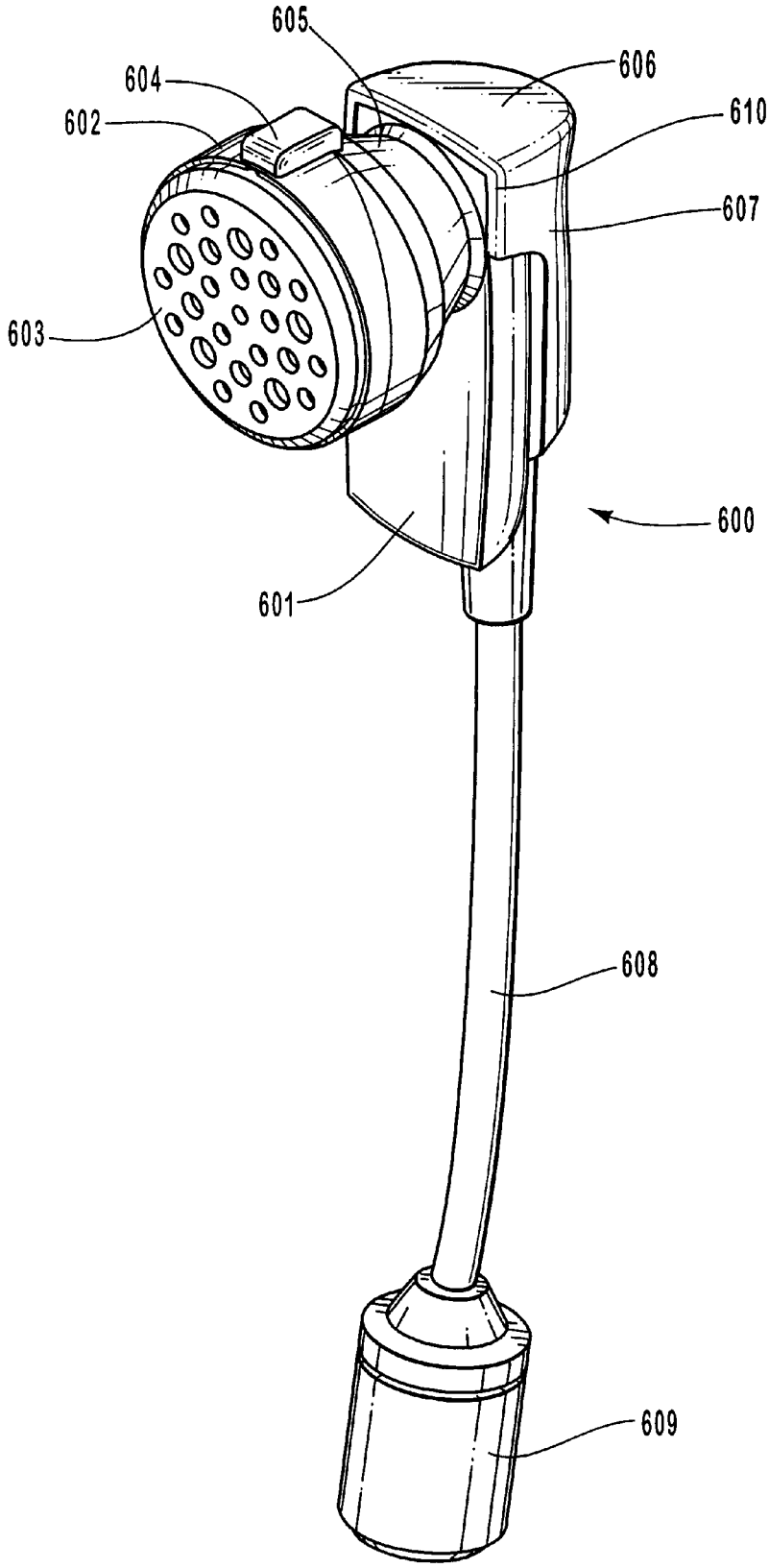
FIG. 6 is a perspective detail drawing of a second present preferred embodiment of this invention.

FIG. 6 shows a perspective detail drawing of a second present preferred embodiment of this invention. This second embodiment 600 employs a boom microphone 609 connected via a cable 608 to the overmold inner housing 601. An overmold outer housing 610, comprising a rear portion 607 and a top portion 606, is fixed to the overmold inner housing 601. As in the first embodiment, shown assembled in FIG. 3, the speaker grill 603 is attached 602 to the snap ring 604, which is a part of the 605 ABS inner shell. This embodiment 600 makes use of a boom microphone 609 rather than the miniaturized microphone 202 of the first embodiment 300.

Figure 7:
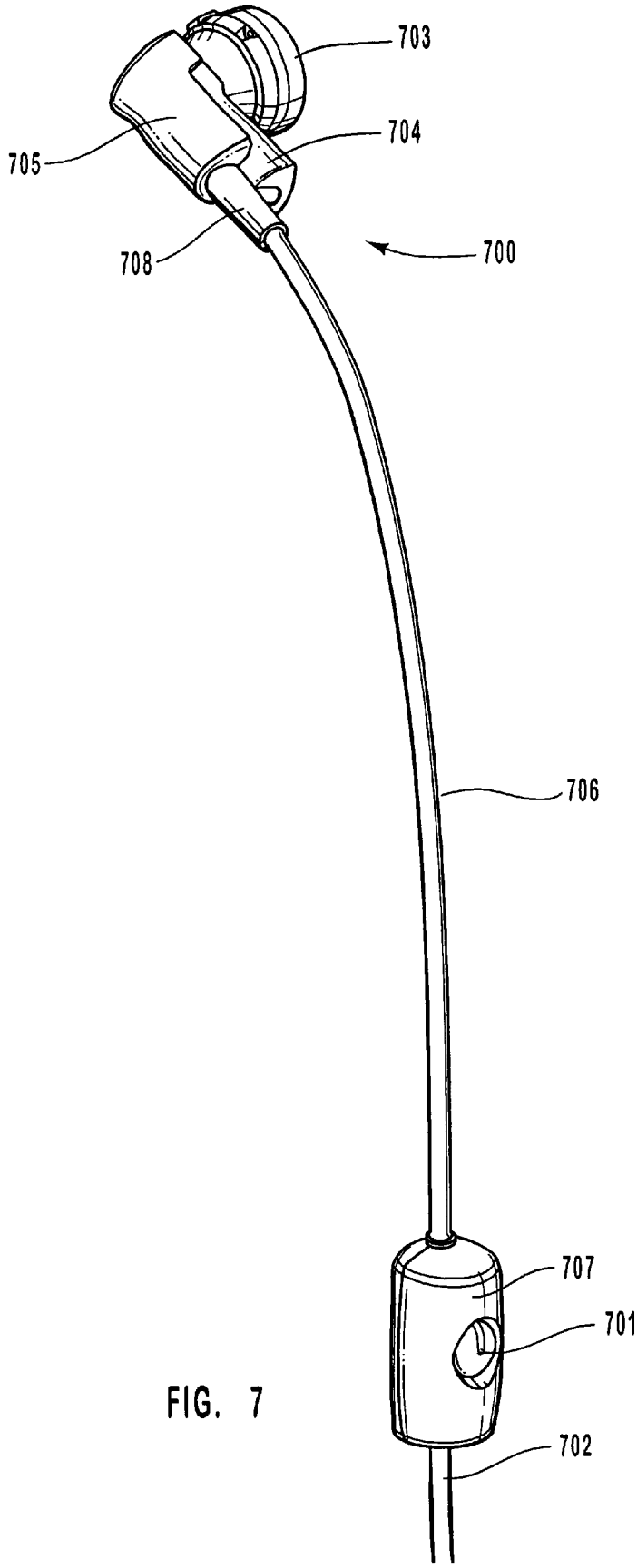
FIG. 7 is a perspective detail drawing of a third present preferred embodiment of this invention.

FIG. 7 shows a perspective detail drawing of a third present preferred embodiment of this invention. This embodiment 700 uses an "EarBud" speaker/microphone system, with a speaker assembly 703 sized to fit within a user's ear, connected to a small overmold assembly 704, 705. The overmold post 708 provides the strain relief between the internal wiring (not shown) of the speaker assembly 703 with the external wiring 706, which electrically connects the speaker 703 to the microphone housing 707. The microphone housing 707 is provided with a microphone on/off selection button/switch 701, which permits the user to turn off the microphone 709 during conversation. The telephone cable connection 702 is provided from the microphone 709 and includes both wiring to the microphone 709 and the speaker 703.

The foregoing description is of several example embodiments of the invention as presently envisioned by the inventors and has been presented for the purposes of illustration and description of the best mode of the invention currently known to the inventors. This description is not intended to be exhaustive of all possible embodiments, nor is it intended to limit the invention to the precise form, connections or choice of components described herein. Obvious modifications or variations are possible and are foreseeable in light of the above teachings. These embodiments of the invention were chosen and described to provide illustrations of the principles of the invention and its practical application to thereby enable one of ordinary skill in the art to utilize the invention in various embodiments and with various modifications as are suited to the particular use contemplated by the inventors. All such modifications and variations are intended to be within the scope of the invention. The scope of the patent protection of this invention should be determined by the appended claims when they are interpreted in accordance with the breadth to which they are fairly, legally and equitably entitled.

We claim:

1. An acoustic/seismic dampening communication device, comprising:

(A) an overmold, said overmold further comprising a top shell having a microphone opening, and a bottom shell; wherein said overmold further comprises:

(1) a rear portion having a first wiring opening and a second wiring opening; and (2) a generally conically shaped wall partion defining an interior cavity for receiving said audio speaker;

(B) an audio speaker fitted within a speaker cavity in said overmold;

(C) a microphone, in a microphone recess, behind said speaker cavity, defined by said bottom shell of said overmold and by a rear portion of said microphone recess and wherein said rear portion of said microphone recess provides acoustic isolation between said audio speaker and said microphone;

(D) a stem attached to said overmold;

(E) a telephone connection wire connected to said stem; and (F) a microphone grill positioned between said microphone opening and said microphone.

2. An acoustic/seismic dampening communication device, as recited in claim 1, wherein said overmold further comprises a snap ring attached to said generally conically shaped wall portion.

3. An acoustic/seismic dampening communication device, as recited in claim 1, wherein said overmold is made of injection molded PVC plastic.

4. An acoustic/seismic dampening communication device, as recited in claim 1, wherein said overmold further comprises a microphone recess for receiving said microphone.

5. An acoustic/seismic dampening communication device, as recited in claim 4, wherein said microphone is held in said microphone recess of said overmold.

6. An acoustic/seismic dampening communication device, as recited in claim 1, wherein said overmold further comprises a top shell fitted to said rear portion of said overmold.

7. An acoustic/seismic dampening communication device, as recited in claim 1, wherein said overmold further comprises a back shell fitted to said rear portion of said overmold.

* * * * *